US008948423B2

(12) United States Patent
Kim

(10) Patent No.: US 8,948,423 B2
(45) Date of Patent: Feb. 3, 2015

(54) MICRO SPEAKER

(71) Applicant: PSI Korea Inc., Seoul (KR)

(72) Inventor: Heung Bae Kim, Bucheon-si (KR)

(73) Assignee: PSI Korea Inc., Seoul (KR)

( * ) Notice: Subject to any disclaimer, the term of this patent is extended or adjusted under 35 U.S.C. 154(b) by 0 days.

(21) Appl. No.: 13/973,851

(22) Filed: Aug. 22, 2013

(65) Prior Publication Data

US 2014/0363034 A1 Dec. 11, 2014

(30) Foreign Application Priority Data

Jun. 5, 2013 (KR) ..... 10-2013-0064677

(51) Int. Cl.
*H04R 25/00* (2006.01)

(52) U.S. Cl.
USPC ..... 381/182; 381/396

(58) Field of Classification Search
USPC ..... 381/335, 182, 386, 396
See application file for complete search history.

(56) References Cited

U.S. PATENT DOCUMENTS 4,720,868 A * 1/1988 Hirano ..... 381/182
7,130,441 B2 * 10/2006 Tsumori et al. ..... 381/182

* cited by examiner

*Primary Examiner* — Suhan Ni
(74) *Attorney, Agent, or Firm* — Fenwick & West LLP

(57) ABSTRACT

Disclosed herein is a micro speaker capable of having a high-pitched sound speaker unit and a low-pitched sound speaker unit and allowing the respective speaker units to clearly reproduce an inherent sound without interference. The micro speaker for converting an electrical signal into an acoustic signal includes: a high-pitched sound speaker unit disposed in an outer case; and a low-pitched sound speaker unit disposed in the outer case together with the high-pitched sound speaker unit, wherein the high-pitched sound speaker unit and the low-pitched sound speaker unit are disposed in the outer case so that a high-pitched sound vibrating plate of the high-pitched sound speaker unit and a low-pitched sound vibrating plate of the low-pitched sound speaker unit have directions opposite to each other.

4 Claims, 2 Drawing Sheets

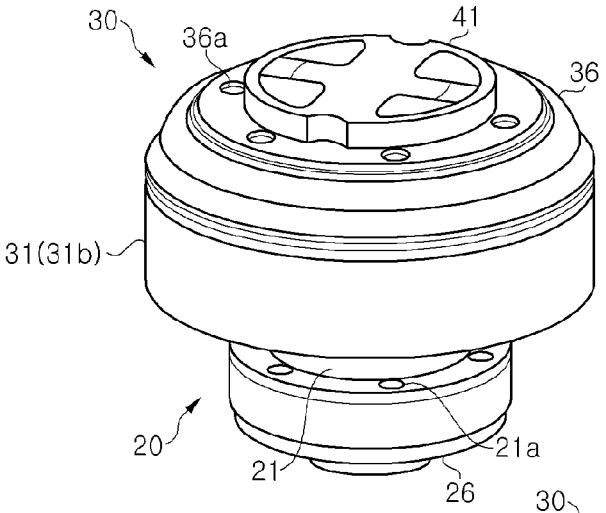
Fig. 3
Fig. 4
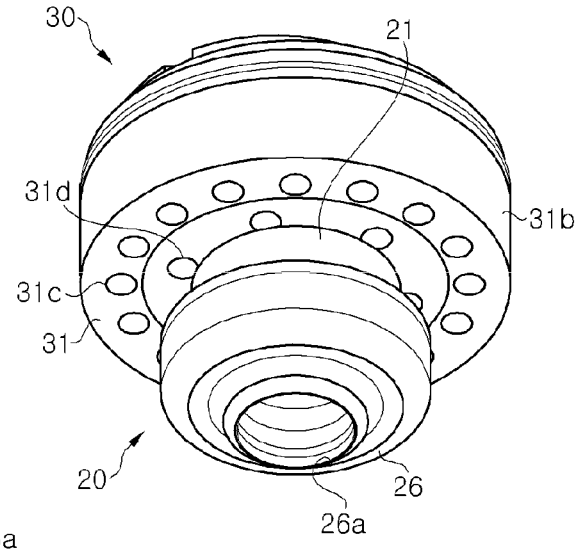
Fig. 5
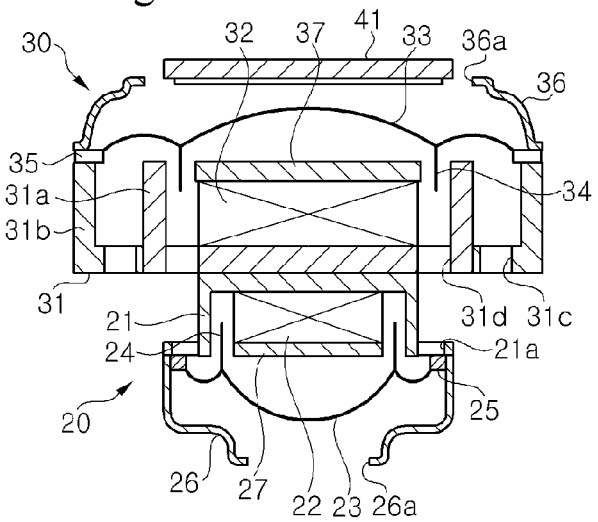

MICRO SPEAKER

CROSS-REFERENCE TO RELATED APPLICATION

This application claims priority of Korean Patent Application No. 10-2013-0064677, filed on Jun. 5, 2013, in the Korean Intellectual Property Office, which is hereby incorporated by reference in its entirety.

BACKGROUND

1. Field

The present invention relates to a micro speaker for converting an electrical signal into an acoustic signal, and more particularly, to a micro speaker capable of having a high-pitched sound speaker unit and a low-pitched sound speaker unit and allowing the respective speaker units to clearly reproduce an inherent sound without interference.

2. Discussion of the Background

Generally, a micro speaker has been used in an earphone or a headphone. In addition, as electronic products such as a smart phone, an MP3 player, a cellular phone, a personal digital assistant (PDA), a laptop computer, and the like, as well as a portable radio and a cassette tape player have gradually become small and light, portability of these electronic components has further increased.

In order to listen to audio information using these portable electronic products without inconveniencing the people around users of these portable electronic products, it is necessary to use an earphone or a headphone mounted with a micro speaker. Therefore, the use of the micro speaker has gradually increased.

However, in the case in which a high-pitched sound speaker unit and a low-pitched sound speaker unit are assembled together in one speaker, since a magnitude of a high-pitched and generated sound generated from the general high-pitched sound speaker unit is relatively smaller than a magnitude of a low-pitched and generate sound from the low-pitched sound speaker unit, it may be difficult to accurately reproduce a sound.

Therefore, continuous research and development for improving sound quality of a micro speaker having the high-pitched sound speaker unit and the low-pitched sound speaker unit are demanded.

Korean Patent No. 10-1045613 is related to this invention.

BRIEF SUMMARY OF THE INVENTION

An object of the present invention is to provide a micro speaker capable of clearly reproducing a generated sound of the respective speaker units by assembling a high-pitched sound speaker unit and a low-pitched sound speaker unit in one speaker and by disposing vibrating plates included in the respective speaker units so as to have directions facing each other and forming a rear opening in the high-pitched sound speaker unit so as to direct toward a rear surface.

According to an aspect of the present invention, there is provided a micro speaker for converting an electrical signal into an acoustic signal, the micro speaker including: a high-pitched sound speaker unit disposed in an outer case; and a low-pitched sound speaker unit disposed in the outer case together with the high-pitched sound speaker unit, wherein the high-pitched sound speaker unit and the low-pitched sound speaker unit are disposed in the outer case so that a high-pitched sound vibrating plate of the high-pitched sound speaker unit and a low-pitched sound vibrating plate of the low-pitched sound speaker unit have directions opposite to each other.

A high-pitched sound frame of the high-pitched sound speaker unit may be provided with a high-pitched sound rear opening opened so as to direct a rear from the high-pitched sound vibrating plate, such that a sound radiated from the low-pitched sound speaker unit may be entered into the high-pitched sound speaker unit through the high-pitched sound rear opening.

The high-pitched sound speaker unit may have a size smaller than that of the low-pitched sound speaker unit.

The high-pitched sound vibrating plate of the high-pitched sound speaker unit may be disposed so as to direct toward an eardrum of a user and the low-pitched sound vibrating plate of the low-pitched sound speaker unit may be disposed so as to direct toward a side opposite to the eardrum of the user.

A high-pitched sound frame of the high-pitched sound speaker unit may be provided with a high-pitched sound rear opening opened toward a rear of the high-pitched sound vibrating plate, and a low-pitched sound frame of the low-pitched sound speaker unit may be provided with a front opening and an auxiliary opening opened toward a front of the low-pitched sound vibrating plate, and the high-pitched sound speaker unit may have a size smaller than that of the low-pitched sound speaker unit and the high-pitched sound rear opening may be disposed on a straight line with the auxiliary opening.

According to another aspect of the present invention, there is provided a micro speaker for converting an electrical signal into an acoustic signal, the micro speaker including: a high-pitched sound speaker unit disposed in an outer case; and a low-pitched sound speaker unit disposed in the outer case together with the high-pitched sound speaker unit, wherein the high-pitched sound speaker unit includes a high-pitched sound frame having an inner space opened so as to direct toward an eardrum of a user, a high-pitched sound magnet attached to the inner space of the high-pitched sound frame, a high-pitched sound vibrating plate disposed at a front of the high-pitched sound magnet, and a high-pitched sound voice coil vibrating the high-pitched sound vibrating plate as vibrating in cooperation with the high-pitched sound magnet, the low-pitched sound speaker unit includes a low-pitched sound frame having an inner space opened so as to direct toward a side opposite to the eardrum of the user, a low-pitched sound magnet attached to the inner space of the low-pitched sound frame, a low-pitched sound vibrating plate disposed at a rear of the low-pitched sound magnet, and a low-pitched sound voice coil vibrating the low-pitched sound vibrating plate as vibrating in cooperation with the low-pitched sound magnet, and the high-pitched sound speaker unit and the low-pitched sound speaker unit are disposed in the outer case so that the high-pitched sound vibrating plate and the low-pitched sound vibrating plate have directions opposite to each other.

The high-pitched sound frame may have a plurality of high-pitched rear openings opened toward the rear and arranged in a circular shape having a predetermined interval.

The low-pitched sound frame may include an internal side wall and an external side wall forming a concentric circle and the low-pitched sound magnet may be attached to the internal side wall.

A plurality of front openings may be arranged between the internal side wall and the external side wall in the circular shape having a predetermined interval and a plurality of auxiliary openings are arranged between the internal side wall and a portion to which the low-pitched sound magnet is attached in the circular shape having a predetermined interval.

The high-pitched sound rear opening may be disposed on a straight line with the auxiliary opening.

BRIEF DESCRIPTION OF THE DRAWINGS

FIG. 3 is a perspective view from above the micro speaker in a state in which an outer case is removed according to the exemplary embodiment of the present invention;

FIG. 4 is a perspective view from below the micro speaker in a state in which the outer case is removed according to the exemplary embodiment of the present invention; and FIG. 5 is a cross-sectional view of the micro speaker in a state in which the outer case is removed according to the exemplary embodiment of the present invention.

DETAILED DESCRIPTION OF THE ILLUSTRATED EMBODIMENTS

Hereinafter, a micro speaker according to an exemplary embodiment of the present invention will be described in detail with reference to the accompanying drawings.

Figure 1:
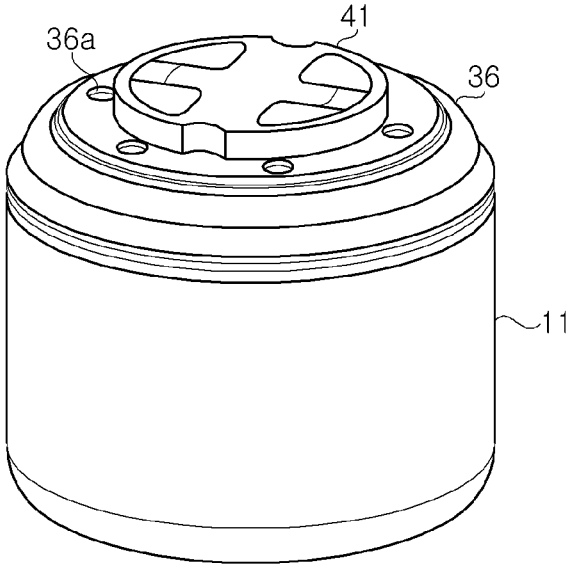
FIG. 1 is a perspective view from above a micro speaker according to an exemplary embodiment of the present invention.
Figure 2:
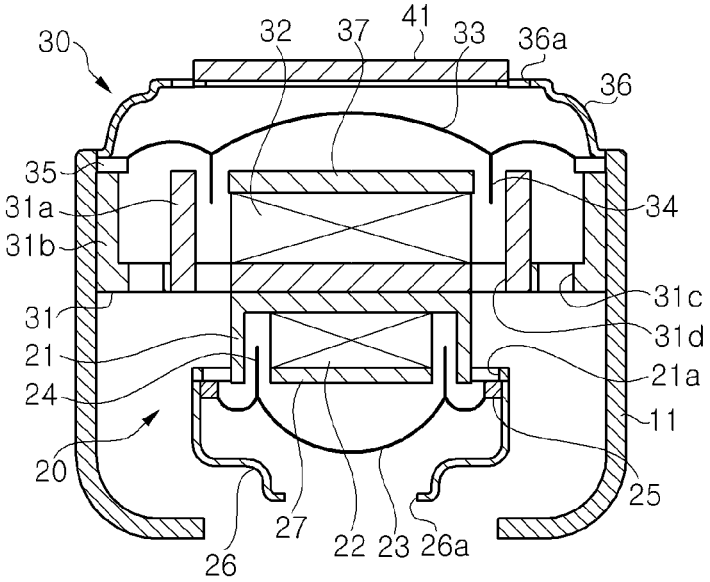
FIG. 2 is a cross-sectional view of the micro speaker according to the exemplary embodiment of the present invention.

FIGS. 1 and 2 show perspective and cross-sectional views of a micro speaker according to an exemplary embodiment of the present invention and FIGS. 3 to 5 show perspective and cross-sectional views of the micro speaker in a state in which an outer case is removed according to the exemplary embodiment of the present invention.

As shown in FIGS. 1 to 5, the micro speaker according to the exemplary embodiment of the present invention used to convert an electrical signal into an acoustic signal includes a high-pitched sound speaker unit 20 and a low-pitched sound speaker unit 30 disposed in an outer case 11.

The high-pitched sound speaker unit 20 and the low-pitched sound speaker unit 30 are disposed so that directions of vibrating plates included in the respective speaker units are opposite to each other. That is, the high-pitched sound speaker unit 20 having a relatively small size is disposed so that a high-pitched sound vibrating plate 23 directs toward an eardrum of a user and the low-pitched sound speaker unit 30 having a relatively large size is disposed so that a low-pitched sound vibrating plate 33 directs toward a side opposite to the eardrum of the user.

In the present specification, a front or a front surface means a side toward the eardrum of the user, and a rear or a rear surface means a side opposite to the eardrum of the user.

When two speaker units having the same direction and phase of the vibrating plates as each other are disposed in one space and then reproduce a sound, a sound in the same frequency band among the sound reproduced from the respective speaker units is partially offset, thereby making it impossible to normally reproduce the sound.

Since the micro speaker according to the exemplary embodiment of the present invention has two speaker units, that is, the high-pitched sound speaker unit 20 and the low-pitched sound speaker unit 30 together disposed in one space, but disposed so that the directions of the high-pitched vibrating plate 23 and the low-pitched sound vibrating plate 33 are opposite to each other as described above, it generates speech waveforms having the opposite phase and having the reproduced frequency bands different from each other, thereby making it possible to reproduce an inherent sound of the respective speaker units without offsetting the respective generated sound with each other.

The high-pitched sound speaker unit 20 includes a high-pitched sound frame 21 having an inner space opened so as to direct toward the eardrum of the user, that is, the front, a high-pitched sound magnet 22 attached to the inner space of the high-pitched sound frame 21, a high-pitched sound vibrating plate 23 disposed at the front of the high-pitched sound magnet 22, and a high-pitched sound voice coil 24 disposed between the high-pitched sound magnet 22 and the high-pitched sound frame 21 so as to vibrate the high-pitched sound vibrating plate 23 as vibrating in cooperation with the high-pitched sound magnet 22.

The high-pitched sound voice coil 24 may be fixed to the high-pitched sound frame 21 by a fixing ring 25. The high-pitched sound frame 21 has a high-pitched sound cap 26 attached to the front surface thereof, wherein the high-pitched sound cap 26 has a funnel shape having a diameter decreasing toward the front. Similar to the related art, the high-pitched sound magnet 22 has a high-pitched sound plate 27 attached to the front surface thereof.

The high-pitched sound frame 21 is provided with a plurality of high-pitched sound rear openings 21*a* opened toward the rear. The plurality of high-pitched sound rear openings 21*a* may be formed at an outer circumferential portion of the high-pitched sound frame 21 to which the fixing ring 25 is attached, having a predetermined interval. The high-pitched sound cap 26 has a center opening 26*a* opened toward the front. The high-pitched sound cap 26 serves to protect the high-pitched sound vibrating plate 23 and collect a generated high-pitched sound.

The low-pitched sound speaker unit 30 includes a low-pitched sound frame 31 having an inner space opened so as to direct toward the side opposite to the eardrum of the user, that is, the rear, a low-pitched sound magnet 32 attached to the inner space of the low-pitched sound frame 31, a low-pitched sound vibrating plate 33 disposed at the rear of the low-pitched sound magnet 32, and a low-pitched sound voice coil 34 disposed between the low-pitched sound magnet 32 and the low-pitched sound frame 31 so as to vibrate the low-pitched sound vibrating plate 33 as vibrating in cooperation with the low-pitched sound magnet 32.

The low-pitched sound voice coil 34 may be fixed to the low-pitched sound frame 31 by a fixing ring 35. The low-pitched sound frame 31 has a low-pitched sound cap 36 attached to the rear surface thereof, wherein the low-pitched sound cap 36 has the funnel shape having a diameter decreasing toward the rear. Similar to the related art, the low-pitched sound magnet 32 has a low-pitched sound plate 37 attached to the front surface thereof. The low-pitched sound cap 36 has a printed circuit board 41 attached to the rear thereof.

The low-pitched sound frame 31 has two concentric side walls, that is, an internal side wall 31*a* and an external side wall 31*b*. The low-pitched sound magnet 32 and the low-pitched sound voice coil 34 are disposed in an inner side of the internal side wall 31*a*. A plurality of front openings 31*c* are arranged between the internal side wall 31*a* and the external side wall 31*b* of the low-pitched sound frame 31 in a circular shape having a predetermined interval, and a plurality of auxiliary openings 31*d* are formed between the internal side wall 31*a* of the low-pitched sound frame 31 and a portion to which the low-pitched sound magnet 32 is attached so as to direct toward the front. The plurality of auxiliary openings 31*d* are also arranged in the circular shape having the predetermined interval.

The low-pitched sound cap 36 is provided with a plurality of low-pitched sound rear openings 36*a* opened toward the rear. The plurality of low-pitched sound rear openings 36*a* may be arranged around the printed circuit board 41 in the circular shape having the predetermined interval.

The high-pitched sound frame 21 is attached to the low-pitched sound frame 31 positioned at one side (i.e., the rear) of an inner portion of the outer case 11 so as to be disposed in the inner portion of the outer case 11, and the high-pitched sound frame 21 and the low-pitched sound frame 31 are disposed in the outer case 11 so that the respective inner spaces thereof are opened toward a direction opposite to each other.

As described above, the high-pitched sound speaker unit 20 is relatively smaller than the low-pitched sound speaker unit 30. As shown in FIGS. 2 and 5, a diameter of the high-pitched sound frame 21 may correspond to the low-pitched sound magnet 32. Therefore, the high-pitched sound rear opening 21*a* formed at the high-pitched sound frame 21 may be disposed on a straight line with the auxiliary opening 31*d* formed at the low-pitched sound frame 31.

If two speaker units having sizes different from each other are disposed in one space, band sound reproduction of a speaker unit having a small size is overlapped by band sound reproduction of a speaker unit having a large size, such that it is difficult to reproduce a normal sound.

Since a general high-pitched sound speaker unit has a structure in which the rear surface is entirely closed and only the front surface is opened, based on the vibrating plate, there is a limitation in loudly reproducing the high-pitched sound. That is, since the low-pitched sound speaker unit has a magnitude of a relatively large reproduction sound, it is difficult to accurately reproduce a reproduction sound of the high-pitched sound speaker unit having a magnitude of a relative small reproduction sound.

In the case in which only the front surface of the high-pitched sound speaker unit is opened, a vibrating sound of the low-pitched sound speaker unit of a relatively large magnitude applies force to the front surface of the high-pitched speaker unit to thereby cause a result interfering in vibrating the high-pitched sound vibrating plate, and a function of the high-pitched sound speaker unit is not fully performed.

According to the exemplary embodiment of the present invention, since the high-pitched sound frame 21 of the high-pitched sound speaker unit 20 is provided with the high-pitched sound rear opening 21*a* opened so as to direct toward the rear from the high-pitched sound vibrating plate 23, the sound radiated from the low-pitched sound speaker unit 30 is entered into the high-pitched sound speaker unit 20 through the high-pitched sound rear opening 21*a* to thereby help the high-pitched sound vibrating plate to vibrate, thereby making it possible to reproduce a larger high-pitched sound.

In addition, according to the exemplary embodiment of the present invention, since the interval is present between the high-pitched sound vibrating plate 23 and the low-pitched sound vibrating plate 33, the time in which the reproduction sound generated from the respective vibrating plates arrive at the eardrum of a listener is different, thereby making it possible to implement an grown sound at the time of listening to the sound.

According to the exemplary embodiment of the present invention as described above, the micro speaker may be provided which assembles the high-pitched sound speaker unit and the low-pitched sound speaker unit together in one speaker and disposes the vibrating plates included in the respective speaker units so as to have the directions of the vibrating plates opposite to each other and forms the rear opening in the high-pitched sound speaker unit so as to direct toward the rear surface.

The micro speaker according to the embodiment of the present invention may clearly reproduce the generated sound of the respective speaker units while installing the high-pitched sound speaker unit and the low-pitched sound speaker unit in one speaker together.

Although the micro speaker according to the exemplary embodiment of the present invention has been described with reference to the accompanying drawings, the present invention is not limited to the above-mentioned exemplary embodiment and drawings but may be variously modified and changed within the following claims by those skilled in the art to which the present invention pertains.

What is claimed is:

1. A micro speaker for converting an electrical signal into an acoustic signal, the micro speaker comprising:

a high-pitched sound speaker unit disposed in an outer case; and a low-pitched sound speaker unit disposed in the outer case together with the high-pitched sound speaker unit, wherein the high-pitched sound speaker unit and the low-pitched sound speaker unit are disposed in the outer case so that a high-pitched sound vibrating plate of the high-pitched sound speaker unit and a low-pitched sound vibrating plate of the low-pitched sound speaker unit have directions opposite to each other, wherein a high-pitched sound frame of the high-pitched sound speaker unit is provided with a high-pitched sound rear opening opened toward a rear of the high-pitched sound vibrating plate, and a low-pitched sound frame of the low-pitched sound speaker unit is provided with a front opening and an auxiliary opening opened toward a front of the low-pitched sound vibrating plate, and wherein the high-pitched sound speaker unit has a size smaller than that of the low-pitched sound speaker unit and the high-pitched sound rear opening is disposed on a straight line with the auxiliary opening.

2. The micro speaker of claim 1, wherein a high-pitched sound frame of the high-pitched sound speaker unit is provided with a high-pitched sound rear opening opened so as to direct a rear from the high-pitched sound vibrating plate, such that a sound radiated from the low-pitched sound speaker unit is entered into the high-pitched sound speaker unit through the high-pitched sound rear opening.

3. A micro speaker for converting an electrical signal into an acoustic signal, the micro speaker comprising:

a high-pitched sound speaker unit disposed in an outer case; and a low-pitched sound speaker unit disposed in the outer case together with the high-pitched sound speaker unit, wherein the high-pitched sound speaker unit includes a high-pitched sound frame having an inner space opened so as to direct toward an eardrum of a user, a high-pitched sound magnet attached to the inner space of the high-pitched sound frame, a high-pitched sound vibrating plate disposed at a front of the high-pitched sound magnet, and a high-pitched sound voice coil vibrating the high-pitched sound vibrating plate as vibrating in cooperation with the high-pitched sound magnet, the low-pitched sound speaker unit includes a low-pitched sound frame having an inner space opened so as to direct toward a side opposite to the eardrum of the user, a low-pitched sound magnet attached to the inner space of the low-pitched sound frame, a low-pitched sound vibrating plate disposed at a rear of the low-pitched sound magnet, and a low-pitched sound voice coil vibrating the low-pitched sound vibrating plate as vibrating in cooperation with the low-pitched sound magnet, and the high-pitched sound speaker unit and the low-pitched sound speaker unit are disposed in the outer case so that the high-pitched sound vibrating plate and the low-pitched sound vibrating plate have directions opposite to each other.

4. The micro speaker of claim 3, wherein the high-pitched sound frame has a plurality of high-pitched rear openings opened toward the rear and arranged in a circular shape having a predetermined interval, the low-pitched sound frame includes an internal side wall and an external side wall forming a concentric circle and the low-pitched sound magnet is attached to the internal side wall, a plurality of front openings are arranged between the internal side wall and the external side wall in the circular shape having a predetermined interval and a plurality of auxiliary openings are arranged between the internal side wall and a portion to which the low-pitched sound magnet is attached in the circular shape having a predetermined interval, and the high-pitched sound rear opening is disposed on a straight line with the auxiliary opening.

* * * * *